United States Patent [19]

Brossia et al.

[11] Patent Number: 4,989,434

[45] Date of Patent: Feb. 5, 1991

[54] METHOD AND APPARATUS FOR DOMING CAN BOTTOMS

[75] Inventors: Charles E. Brossia, Highlands Ranch; Roblee L. Talbott, Golden; Ronald B. Peterson, Arvada; Warren R. Williams, Fort Collins, all of Colo.

[73] Assignee: Adolph Coors Company, Golden, Colo.

[21] Appl. No.: 391,959

[22] Filed: Aug. 9, 1989

[51] Int. Cl.[5] ..... B21D 22/16

[52] U.S. Cl. ..... 72/82

[58] Field of Search ..... 72/81-85

[56] References Cited

U.S. PATENT DOCUMENTS

| | | | |
|---|---|---|---|
| 64,422 | 5/1867 | Hulbert | 72/85 |
| 80,836 | 8/1868 | Seymour | 72/83 |
| 100,912 | 3/1870 | Marcy | 72/83 |
| 150,796 | 5/1874 | Seymour | 72/83 |
| 2,069,356 | 2/1937 | Cooperstein | 72/82 |
| 3,248,918 | 5/1966 | Brown | 72/81 |
| 3,556,032 | 1/1971 | Fraze | 72/85 |
| 3,730,383 | 5/1973 | Dunn et al. | 220/66 |
| 4,151,927 | 5/1979 | Cvacho et al. | 220/70 |
| 4,222,494 | 9/1980 | Lee, Jr. et al. | 220/66 |
| 4,372,143 | 2/1983 | Elert et al. | 72/347 |
| 4,404,507 | 9/1983 | Dean et al. | 318/570 |
| 4,454,742 | 6/1984 | Gombas | 72/115 |
| 4,509,351 | 4/1985 | Rolin et al. | 72/83 |
| 4,565,081 | 1/1986 | Massee | 72/83 |
| 4,723,433 | 2/1988 | Grims | 72/348 |

FOREIGN PATENT DOCUMENTS

| | | | |
|---|---|---|---|
| 1030112 | 6/1953 | France | 72/83 |

OTHER PUBLICATIONS

Sketch A.

*Primary Examiner*—Robert L. Spruill
*Attorney, Agent, or Firm*—Klaas & Law

[57] ABSTRACT

This invention provides method and apparatus for reshaping the bottom wall of an aluminum can body wherein a mold member having a generally cylindrical outer surface having a longitudinal axis and a contoured bottom surface is mounted for rotation in a support structure and an aluminum can body having a generally cylindrical sidewall having a longitudinal axis and an integral bottom wall is secured on the mold member so that an annular portion of the bottom wall contacts at least an annular portion of the contoured bottom surface and the longitudinal axes thereof coincide. As the mold member and the can body are rotated, resilient forces are applied to the bottom wall using a tool member having a spherical surface which is moved in a diametrical linear direction across the bottom wall to reshape the bottom wall into conformation with the contoured bottom surface.

12 Claims, 2 Drawing Sheets

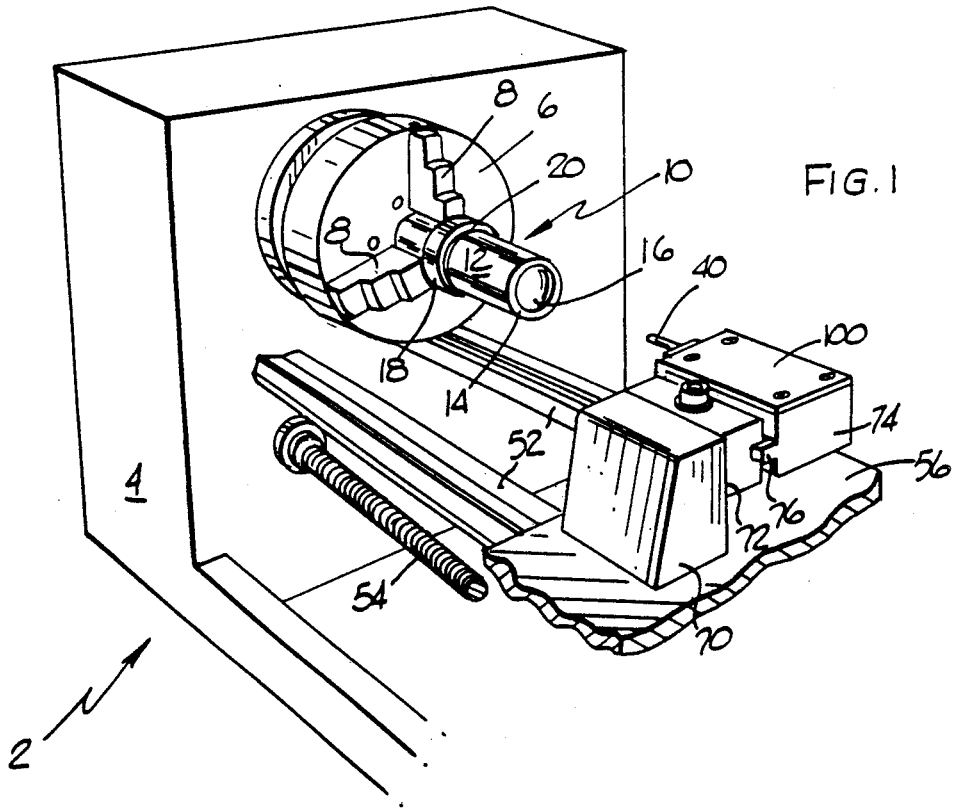
FIG. 1
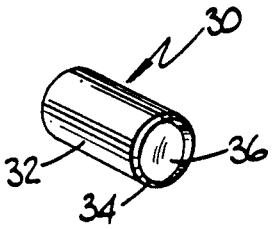
FIG. 2
FIG. 4
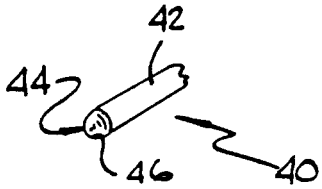
FIG. 3
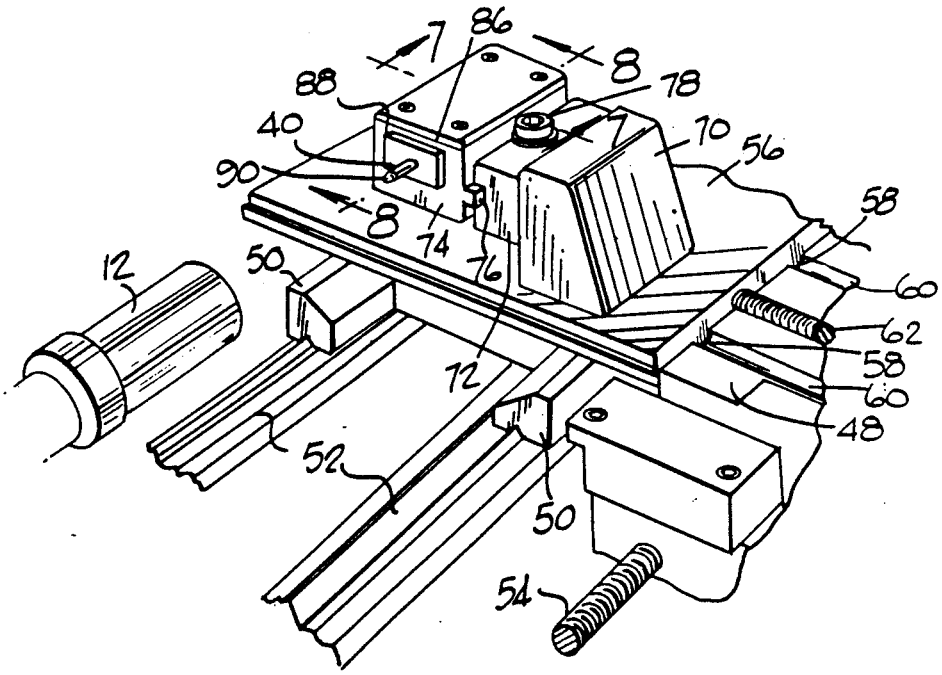

FIG. 5
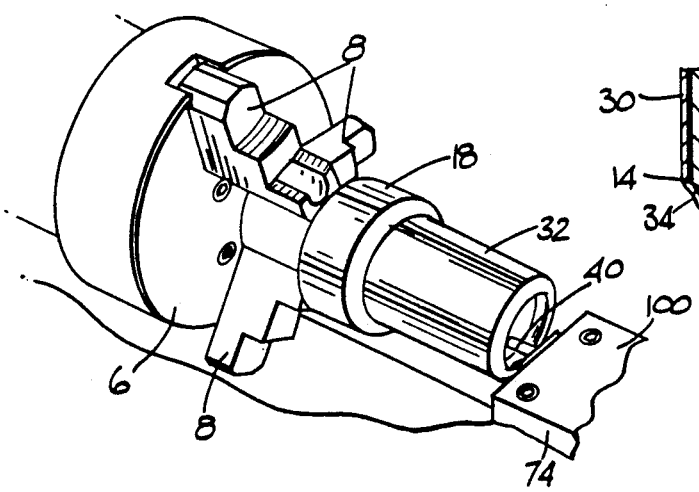
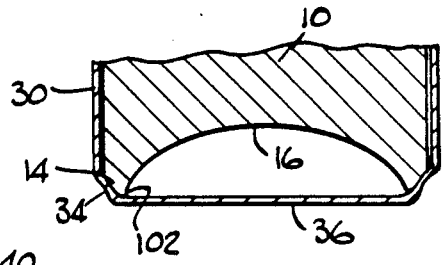
FIG. 9
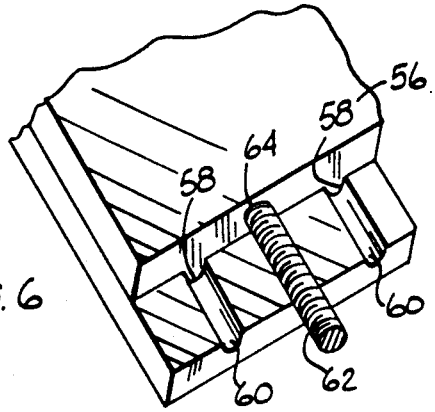
FIG. 6
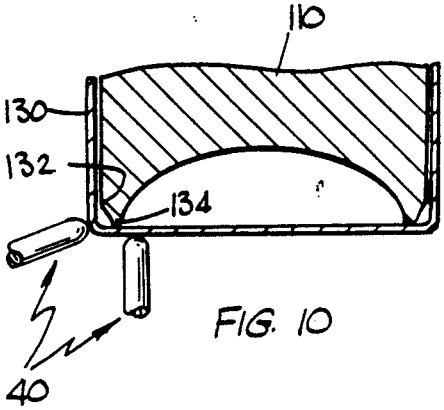
FIG. 10
FIG. 7
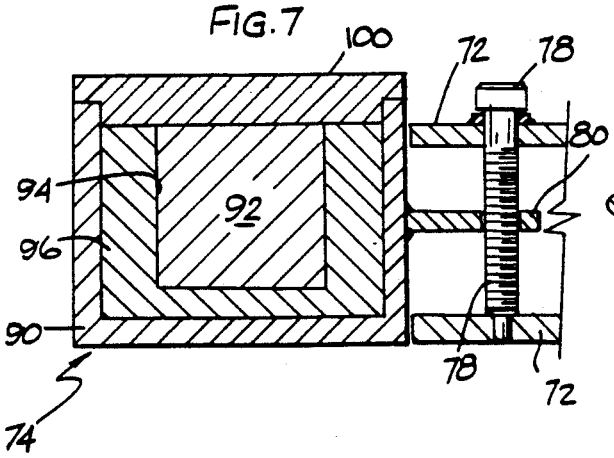
FIG. 8
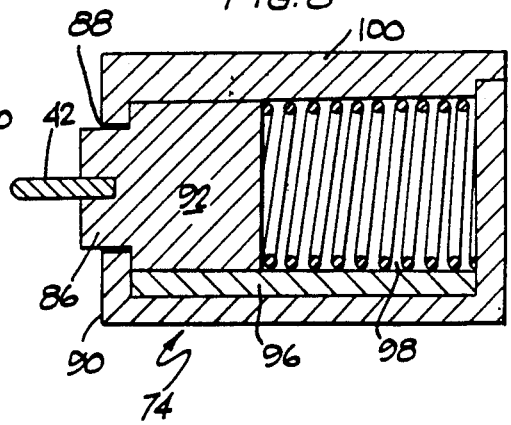

METHOD AND APPARATUS FOR DOMING CAN BOTTOMS

FIELD OF THE INVENTION

This invention relates generally to method and apparatus for shaping the bottom wall of a can body and more particularly to method and apparatus for shaping a thin walled aluminum can body of the type having a cylindrical sidewall and an integrally formed bottom wall.

BACKGROUND OF THE INVENTION

The most common method of shaping the bottom wall of a can body having a cylindrical sidewall and an integrally formed bottom wall is to have the can body positioned on a ram having a contoured end and to move the bottom wall against a contoured forming ring and a domer die. In U.S. Pat. No. 4,723,433, the ram comprises a bodymaker punch which has moved a can body through forming dies and into a forming ring to form an annular portion on the can body. The forming ring is mounted on biasing means, such as air cylinders, so as to gradually form the inner domed portion. U.S. Pat. Nos. 3,730,383; 4,151,927; 4,222,494 and 4,372,143 disclose other methods for doming the bottom wall of an aluminum can body. U.S. Pat. No. 4,454,742 discloses the use of rollers to reshape the bottom wall. While these patents all state that they are directed to methods for doming the bottom wall of a can body without shortening the axial length of the original can body, the structures disclosed in these patents would function to at least slightly reduce the axial extent of the original can body during the doming of the can bottom. Therefore, there exists a need for a method for doming a can body without shortening the original axial extent of the can body.

BRIEF DESCRIPTION OF THE INVENTION

This invention provides method and apparatus for reshaping the bottom wall of a can body by mounting a can body having an original overall axial extent on a rotatable mold member, having a contoured bottom surface, for rotation therewith. As the can body is being rotated, a tool member is moved linearly across the bottom wall while a force is applied to the bottom wall by the tool member so as to move the bottom wall into conformation with the contours of the bottom surface without shortening the original overall axial extent of the can body.

In the presently preferred embodiment of the invention, an unshaped can body has a cylindrical sidewall having a longitudinal axis and a bottom wall integrally joined to the cylindrical sidewall wherein the bottom wall between the annular beveled portion is generally planar. A mold member, having a generally cylindrical outer peripheral surface and an integral annular portion for engagement with the bottom wall of the can body, has a contoured bottom surface at least within the annular portion and is mounted for rotation about a central longitudinal axis. The cylindrical sidewall of the can body is placed over the outer peripheral surface and moved in an axial direction until the bottom wall contacts the annular portion. The portion of the cylindrical sidewall next adjacent to the open end of the can body is secured to the mold member for rotation therewith. The amount of force used to secure the can body to the mold member is only that necessary to prevent relative rotational movement between the can body and the mold member. A tool member is mounted for movement in a horizontal linear direction parallel to the longitudinal axis of the mold member and in a horizontal linear direction perpendicular thereto. The tool member is resiliently mounted for movement in horizontal linear directions parallel to the longitudinal axis of the mold member to minimize the possibility of excessive forces being applied to the bottom wall. Control means are provided for moving the tool member in the horizontal parallel linear direction until it is resiliently engaged with the bottom wall as the can body and the mold member are being rotated. The tool member has a spherical end surface that contacts the bottom wall so as to have point contact therewith. The tool member is moved in both the horizontal perpendicular linear direction and the parallel directions to apply forces to the bottom wall while the resilient mounting of the tool member functions to maintain the forces applied in the parallel directions as a controlled force on the bottom wall so as to move successive portions of the bottom wall into conformation with the contours on the bottom surface of the mold member. In the preferred embodiment, the tool member is moved from the annular portion of the mold member toward the longitudinal axis of the can body. If the greatest distance between the bottom wall and the contoured bottom surface is sufficiently great, it may require more than one movement of the tool member between the annular portion and the longitudinal axis of the can body to completely conform the bottom wall to the contoured bottom surface. The forces being applied to the bottom wall by the tool member are of a nature that there is no tendency to draw any material from the cylindrical sidewall of the can body during the reshaping of the bottom wall. The result of this is that the original blank from which the can body is formed can have a smaller diameter so that there can be a substantial total reduction in the amount of original aluminum material used to form the same number and size of can bodies. Also, contours for the bottom wall not available in using the prior art methods can be formed in the bottom wall so as to provide for bottom walls having greater strength and designed to provide greater beverage holding capacity of the can body so as to result in further substantial savings of the original aluminum material.

While applicant is aware of instances wherein a tool member is applied to a rotating body of material to reshape such body of material, he knows of no such method that would render the above-described method for reshaping the bottom wall of a can body obvious therefrom.

BRIEF DESCRIPTION OF THE DRAWINGS

An illustrative and presently preferred embodiment of the invention is shown in the accompanying drawings in which:

FIG. 1 is a perspective view of a portion of apparatus for performing the method of the preferred embodiment of the invention;

FIG. 2 is a perspective view of an unshaped can body;

FIG. 3 is a perspective view of another portion of the apparatus of FIG. 1;

FIG. 4 is an enlarged perspective view of the too member for use in reshaping the bottom wall;

FIG. 5 is a perspective view showing the bottom wall of the can body being shaped;

FIG. 6 is a perspective view of the mounting of the support plate;

FIG. 7 is a cross-sectional view taken on the line 7—7 of FIG. 3;

FIG. 8 is a cross-sectional view taken on the line 8—8 of FIG. 3;

FIG. 9 is a cross-sectional view illustrating one embodiment of a can body and a mold member; and FIG. 10 is a cross-sectional view illustrating another embodiment of a can body and a mold member.

DETAILED DESCRIPTION OF THE INVENTION

The presently preferred method of this invention and apparatus capable of performing such method is illustrated in the drawings. In FIG. 1, there is illustrated a portion of such apparatus and comprises a conventional computer or hand operated lathe 2. A housing 4 is mounted at a fixed location and has suitable conventional drive means (not shown) mounted therein. A turret 6 is rotatably mounted on the housing 4, is rotated by the drive means and has adjustable gripping jaws 8 mounted thereon for rotation therewith. A mold member 10 is held on the turret 6 for rotation therewith by the jaws 8 The mold member 10 has a generally cylindrical outer surface 12 having a longitudinal axis and an annular beveled surface 14 which extends between the cylindrical outer surface 12 and contoured bottom surface 16. A retaining means 18 is mounted on the mold member 10 for rotation therewith and has an annular space 20 between it and the mold member 10 for purposes described below.

An unshaped can body 30 for use with the mold member 10 is illustrated in FIG. 2 and comprises a generally cylindrical sidewall 32 having a longitudinal axis, an integral annular beveled portion 34 and an integral generally planar bottom wall 36. The generally cylindrical sidewall 32 and the integral annular beveled portion 34 are designed to have mating engagement with the generally cylindrical outer surface 12 and the annular beveled surface 14 of the mold member 10 for purposes described below.

A tool member 40, FIG. 4, having an elongated generally cylindrical shank portion 42 having a longitudinal axis and a work engaging portion 44 shaped as a segment of a sphere so as to have a spherical outer surface 46 is mounted on the bed portion of the conventional computer or hand operated lathe 2 for linear movement in relative perpendicular directions in the generally horizontal x and y axes. In some instances, the work engaging portion 44 may have other shapes such as a segment of an ellipsoid. A vertical adjustment is also provided so that the longitudinal axis of the tool member 40 lies in the same horizontal plane as the longitudinal axis of the mold member 10. In the drawings, this is illustrated in FIG. 3 by a base member 48 which is mounted on a pair of spaced apart slide blocks 50 which are positioned for sliding movement over the fixed spaced apart slide guideways 52. The base member 48 is moved over the slide guideway 52 by rotation of the drive screw 54 in a conventional manner. The base member 48 moves in a linear direction along the x axis which is parallel to the longitudinal axis of the mold member 10. A support plate 56, FIGS. 3 and 6, has a pair of spaced apart depending slide flanges 58 which are supported for sliding movement over spaced apart grooves 60. The support plate 56 is moved over the base member 48 by rotation of the driving screw 62 in a threaded opening 64. The support plate 56 moves in a linear direction along the y axis which is perpendicular to the direction of movement of the base member 48.

A support block 70, FIGS. 3 and 7, is mounted on the support plate 56 and has an outwardly projecting portion 72. The tool member 40 is mounted for sliding movement in a housing 74 which is mounted for vertical sliding movement over the outwardly projecting portion 72 which sliding movement is guided by a pair of guides 76 projecting outwardly from the housing 74 and in contact with the outer surface of the support block 70. A rotatable threaded member 78, FIG. 7, is mounted at a fixed location for rotation in the outwardly projecting portion 72 and an outwardly projecting arm 80 is fixedly mounted on the housing 74 and is in threaded engagement with the rotatable threaded member 78 so that rotation thereof moves the housing 74 up or down in a vertical plane that is parallel to the vertical plane in which the longitudinal axis of the mold member 10 lies. In the initial set-up, the support plate 56 and the housing 74 are adjusted so that the longitudinal axes of the can body 30, the mold member 10 and the tool member 40 coincide.

The tool member 40 is mounted for linear sliding movement in the housing 74 as illustrated in FIGS. 7 and 8. The shank portion 42 is secured in a support block 86 having a rectangular cross-sectional configuration and positioned so as to be reciprocated in linear directions through an opening 88 in the front wall 90 of the housing 74 which has a corresponding rectangular cross-sectional configuration. The support block 86 is integral with a body portion 92 which has a rectangular cross-sectional configuration which is larger than the rectangular cross-sectional configuration of the opening 88. The body portion 92 is mounted for sliding movement in a U-shaped groove 94 in support block 96 fixedly secured in the housing 74. A resilient member 98 normally urges the body portion 92 toward the mold member 10 and its movement is stopped by contact with the front wall 90. A cover 100 is removably secured to the housing 74. A coil spring is illustrated as the resilient member, but it is understood that other types of resilient means such as a constant force spring means or a constant force air cylinder can be used to supply the resilient forces. As stated above, the resilient force is only precautionary and the movement of the tool member 40 in the x and y axes may be programmed in a conventional manner.

The above-described apparatus is used to perform the method of this invention in the following manner. The relationship of the can body 30 and the mold member 10 is illustrated in FIG. 9. The mold member 10 is mounted on the turret 6 for rotation therewith so that the longitudinal axis of the mold member 10 coincides with the axis of rotation of the turret 6. A retaining means 18 is secured on the mold member 10 for rotation therewith. An unshaped can body 30, shaped for mating engagement with the mold member 10, is placed over the generally cylindrical outer surface 12 until the end of the cylindrical sidewall 32 has entered into the annular space 20 and an annular portion 102 between the annular beveled portion 34 and the bottom surface 16 is in contact with the bottom wall 36. Suitable means (not shown) in the retaining means 18 are actuated to hold the can body 30 so that it will rotate with the-mold member 10 and the retaining means 18. The tool member 40 is positioned so that the longitudinal axes of the tool member 40 and the mold member 10 coincide so that when the tool member 40 is moved across the bottom wall 36 along the y axis, it will be a diametrical linear movement. The controls for the linear movements of the tool member 40 will have been programmed into the computer. While there are several different methods for programming such linear movements, one method is illustrated in U.S. Pat. No. 4,404,507 which is incorporated herein by reference. The tool member 40 will be moved in linear directions until is contacts the portion of the bottom wall 36 axially opposite to the annular portion 102 on the left side of the illustration in FIG. 9. The tool member 40 will continue movement along the x axis until the body member 92 has moved inwardly an axial distance so that it is exerting a resilient force on the bottom wall 36. The computer controlled tool member 40 will then be moved in a linear directions along the y axis and the x axis. As the tool member 40 moves, the resilient member 98 will apply sufficient force against the tool member 40 so that it will move the material, preferably aluminum, in the bottom wall 36 against the contoured bottom surface 16 so that the bottom wall 36 will be reshaped into conformation with the contoured bottom surface 16. If desired, the tool member 40 may be moved so that its first contact with the bottom wall 36 is approximately at the longitudinal axis of the can body 30, the above-described method is preferred. The wall thickness of the domed portion of the can body can be varied by varying the rate of movement of the tool member 40 in the direction along the x axis and the forces applied thereto. While the rotation of the unshaped can body 30 and the linear movement of the tool member 40 along the y axis and the x axis can be controlled so that the unshaped bottom wall 36 is completely reshaped by the time it reaches the longitudinal axis of the mold member 10, it is preferred to continue the movement of the tool member 40 until it is in contact with the right side of the annular beveled portion 102. If desired, the tool member 40 may also be moved over the beveled portion 34 to ensure that it conforms to the beveled surface 14. If the greatest distance between the bottom wall 36 of an undomed can body 30 and the contoured bottom surface 16 is significantly great, then it is desirable to move the tool member 40 across the bottom wall more than one time. For instance, the first time the tool member 40 is moved across the bottom wall 36, it will be programmed to move the bottom wall 36 only one-half of the distance between the bottom wall 36 and the contoured bottom surface 16 and to move the bottom wall 36 the remaining distance into conformation with the contoured bottom surface 16, the second time the tool member is moved across the bottom wall 36.

In FIG. 10, there is illustrated another embodiment of the relationship between a mold member 110 and a can body 130. While the can body 130 can be formed into the shape of the mold member 110 in a manner similar to that described above, it is preferred to vary the angular relationship of the tool member 40 as it is moved over the can body. As illustrated in FIG. 10, the longitudinal axis of the tool member 40 would have an angular relationship with the longitudinal axes of the mold member 110 and the can body 130 so as to contact the can body 130 opposite to an annular portion 132 of the mold member 110. As the tool member 40 is moved toward the annular portion 134, this angular relationship would be changed until when it has reached the annular portion 134, the longitudinal axis of the tool member 40 is parallel with the longitudinal axes of the mold member 110 and the can body 130. The movement of the tool member 40 would then proceed as described above or if desired, the angular relationship of the longitudinal axis of the tool member 40 to the longitudinal axes of the mold member 110 and the can body 130 on the left side of FIG. 10 to from the annular portion 134 on the left side of FIG. 10 to the right side thereof.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. Method for reshaping a can bottom wall into a desired configuration comprising:

mounting a mold member having a generally cylindrical outer peripheral surface having a longitudinal axis and a contoured bottom surface for rotation about a fixed axis of rotation;

moving a can body having a sidewall having a cylindrical inner surface having a longitudinal axis, an original overall axial extent and an integral bottom wall over said mold member until an annular portion of said bottom wall contacts at least an annular portion of said contoured bottom surface and said longitudinal axes coincide;

securing said can body to said mold member to prevent relative rotational movement therebetween during said rotation of said mold member and said can body;

rotation said mold member and said can body about said fixed axis;

moving a tool member having an outer surface for contacting said bottom wall in at least one linear direction over said bottom wall at least once between said annular portion of said bottom wall to said fixed axis of rotation;

applying forces to said bottom wall by linear movement in another direction of said tool member during said movement thereof in said one linear direction to move said bottom wall into conformation with said contoured bottom surface without changing said original overall axial extent of said can body; and varying the wall thickness of said moved bottom wall of said can body by varying the rate of movement and the applied force of said tool member in said another linear direction.

2. The invention as in claim 1 and further comprising:

forming said outer surface of said tool member as a segment of a sphere so as to provide for point contact between said tool member and said bottom wall.

3. The invention as in claim 2 wherein said step of moving the tool member in at least one linear direction comprises:

moving said tool member along a diametrical linear path extending completely across said bottom wall.

4. The invention as in claim 1 and further comprising:

applying said forces to said bottom wall by moving said tool member in an axial direction substantially parallel to said longitudinal axes of said mold member and said can body.

5. The invention as in claim 1 and further comprising:

resiliently urging said tool member against said bottom wall with a controllable force during the reshaping of said bottom wall into conformation with said contoured bottom surface.

6. Apparatus for reshaping the bottom wall of a can body into a desired configuration comprising:

a support structure mounted at a fixed location;

a turret rotatably mounted in said support structure and having a generally central longitudinal axis of rotation;

drive means for rotating said turret;

a mold member mounted on said turret for rotation therewith;

said mold member having at least a generally cylindrical outer surface having a longitudinal axis and an integral contoured bottom surface;

said mold member adapted to have a can body positioned thereon, said can body having at least a generally cylindrical sidewall, an inner cylindrical surface, a longitudinal axis, an original overall axial extent and an integral bottom wall having an original shape including at least an annular portion;

said generally cylindrical outer surface having a diameter slightly smaller than the diameter of the inner cylindrical surface of said generally cylindrical sidewall so that said can body may be moved over said generally cylindrical outer surface until an annular portion of said bottom wall contacts said at least an annular portion of said contoured bottom surface;

securing means for securing said can body on said mold member for rotation therewith and wherein said longitudinal axes of said turret, said can body and said mold member coincide;

a tool member;

movable support means for supporting said tool member;

said movable support means capable of moving at least in one linear direction across said bottom wall and in another linear direction to apply a force to said bottom wall; and control means for moving said tool member in said another linear direction until said tool member contacts said bottomwall and is applying a force thereto and for moving said tool member in said one linear direction over said bottom wall at least between said annular portion of said bottom wall to said axis of rotation while said force is being applied thereto so as to reshape said bottom wall into conformation with said contoured bottom surface without changing said overall axial extent of said can body; and said control means varying the rate of movement of and the applied force to said tool member in said another linear direction to vary the wall thickness of the reshaped bottom wall.

7. Apparatus as in claim 6 wherein:

said movement in said one linear direction is along a diametrical linear path extending completely across said bottom wall within said annular portion.

8. Apparatus as in claim 6 wherein said can body is formed from aluminum.

9. Apparatus as in claim 6 and further comprising:

mounting means for slidably mounting said tool member for linear sliding movement in a direction parallel to said longitudinal axis of said mold member; and resilient means for urging said tool member against said bottom wall to apply said force to said bottom wall.

10. Apparatus as in claim 9 wherein:

said another linear direction is substantially parallel to said longitudinal axes of said mold member and said can body.

11. Apparatus as in claim 9 wherein:

said movement of said tool member in said another linear direction is continued after said tool member contacts said bottom surface until said tool member has been moved in an axial direction against the action of said resilient means for at least a distance necessary for said tool member to be applying said force as it is moved in said one linear direction.

12. Apparatus as in claim 11 wherein:

said can body is formed from aluminum.

* * * * *